United States Patent [19]

Lin

[11] 4,336,623

[45] Jun. 29, 1982

[54] BATHING BRUSH

[76] Inventor: Yih-Chou Lin, No. 31, Dormitory of E. District, Veterans General Hospital, Shihpai, Taipei, Taiwan

[21] Appl. No.: 150,747

[22] Filed: May 19, 1980

[51] Int. Cl.[3] ..... A47K 7/02

[52] U.S. Cl. ..... 15/222; 4/606; 15/244 B

[58] Field of Search ..... 15/110, 160, 222, 244 B; 4/606; 272/140; 128/62 R, 63, 65, 67

[56] References Cited

U.S. PATENT DOCUMENTS

| | | | |
|---|---|---|---|
| 1,820,256 | 4/1931 | Stewart | **15/244 B** |
| 2,905,957 | 9/1959 | Volpe | **15/222 X** |
| 3,875,933 | 4/1975 | Schwab | **15/222 X** |
| 4,016,622 | 4/1977 | Eisenman | 15/222 |

*Primary Examiner*—Chris K. Moore

*Attorney, Agent, or Firm*—Holman & Stern

[57] ABSTRACT

A velvet-like covered sponge inner-layer bathing brush having a pair of opposed retractable handles each connected to the body of the brush by a set of strings, with retracting means located within said body.

5 Claims, 5 Drawing Figures

BATHING BRUSH

BACKGROUND OF THE INVENTION

Field of the Invention

This invention relates to a sponge covered bathing brush having retractable handles.

SUMMARY OF THE INVENTION

This invention comprises a bathing brush having a body covered with an inner layer of sponge and an outer layer of velvet and two opposed retractable handles, each end of each handle being attached to a string which can be pulled-out and retracted from said body.

The body is made of a flexible plastic material which is covered with an inner layer of sponge and an outer layer of a velvet-type fiber. As a result of these two layers, the bathing brush is not only useful for normal bathing purposes, but also feels rather soft and comfortable to the user. The surface of the brush is corrugated.

The handles are connected to the body by two pairs of strings. The handles are "C" shaped, with one string attached to each end. The other ends of the strings are attached to leaf coil springs located within the brush body. The coil springs are mounted in two sets of two springs each. Each set of coil springs contains two leafs, the ends of which are attached to respective opposed strings of the two handles. The other end of each string is attached to its respective handle through adjusting screws mounted in the center of each handle. The length of each pair of strings may be adjusted by rotating the adjusting screw in its respective handle. Each adjusting screw is mounted in its respective handle so that when it is rotated, both strings of the pair wrap around it or unwrap simultaneously, and the adjusting screw is fixed in position (i.e., prevented from rotating) by pressing it inward toward the handle. Thus, it is possible to adjust the length of each set of strings to that most suitable for the user. Because of this, the bathing brush of this invention is useful in washing one's back as well as in washing parts of the body that are difficult to reach with a conventional brush.

DESCRIPTION OF THE PREFERRED EMBODIMENTS

Figure 1:
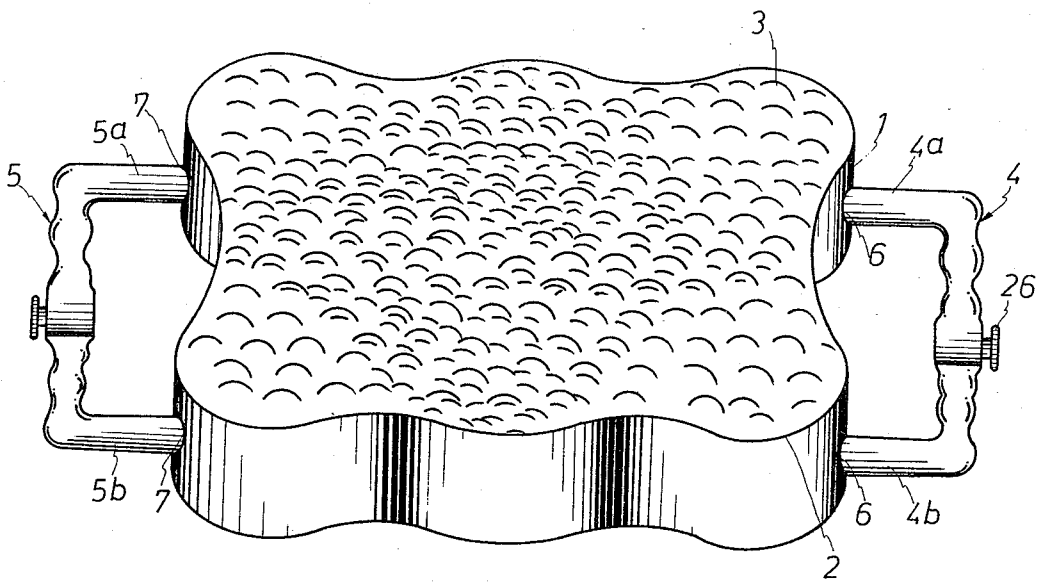
FIG. 1 is a perspective view of this invention.

As shown in FIG. 1, the outer surface of the body 1 is covered by an inner layer of sponge 2, over which is an outer layer of velvet-like material 3, so as to afford a soft and comfortable feed to the user. At the two opposite ends of the body 1 are fitted identical hollow handles 4 and 5 respectively. The ends of handle 4 fit into terminals 4*a* and 4*b* which are in turn fitted into holes 6. The ends of handle 5 fit into terminals 5*a* and 5*b* which are in turn fitted into holes 7.

Figure 2:
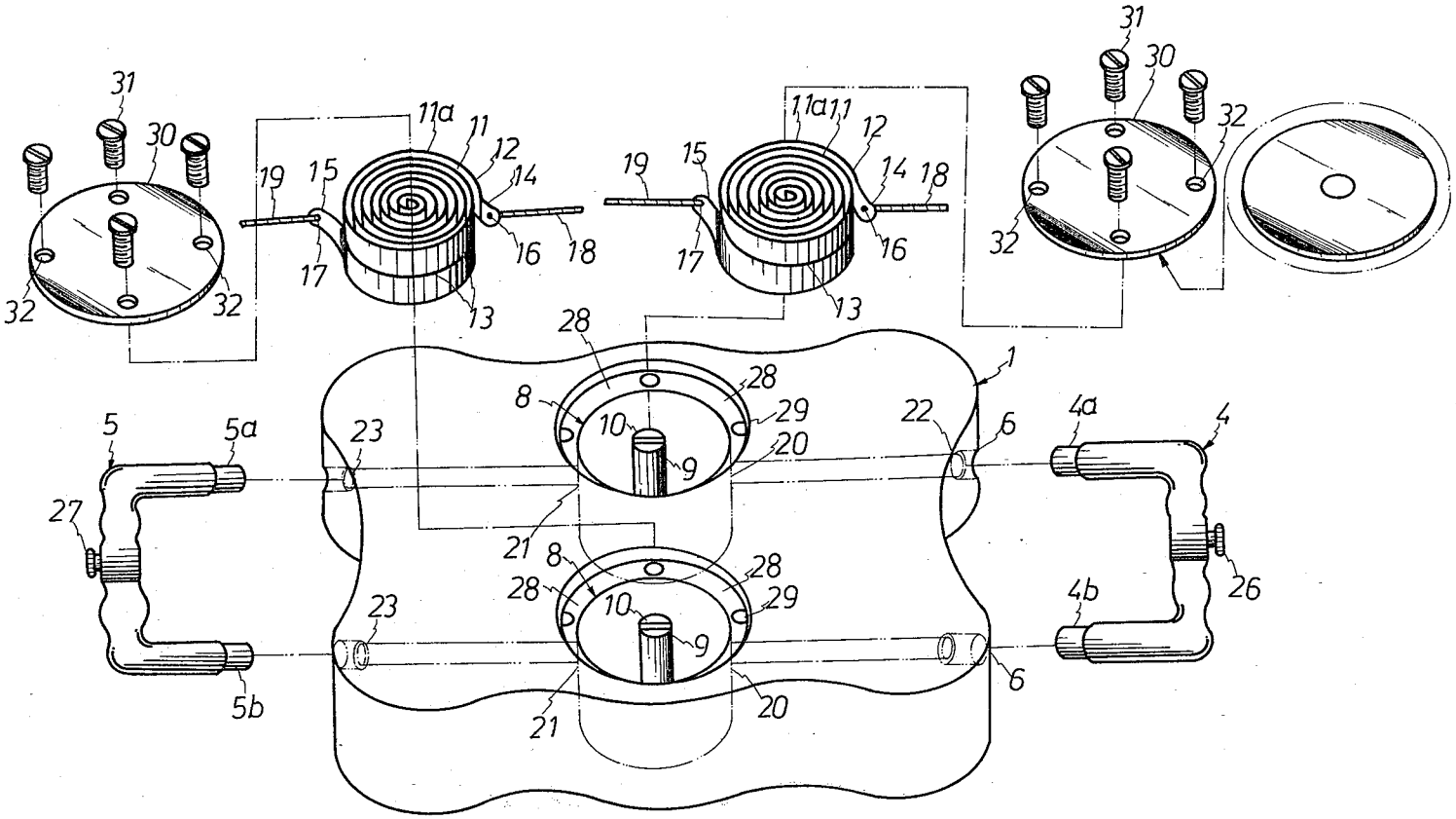
FIG. 2 is an exploded view of the inner structure of the body of this invention.

FIG. 2 shows the inner structure of body 1. Inside the body are two identical coil means, each comprising a cylindrical housing 8 having lids 30 (FIG. 2). In the bottom center of each housing 8 there is a fixed shaft 9 which has a groove 10 for fixing one end 11*a* of coil spring 11. The other end of coil spring 11 is divided into two small leaf springs 12 and 13. Leaf springs 12 and 13 have different lengths, the difference being about equal to one-hald of the inside circumference of cylindrical housing 8. Each leaf spring 12, 13 ends in a lug piece 14 and 15, respectively, and each lug piece has a round hole 16 and 17, respectively, for attaching strings 18 and 19. In the wall of the housing 8 there are two holes 20 and 21 which extend through the body 1 to the holes 6 and 7, forming passages 22 and 23. The strings 18, 19 extend through the passages 22, 23, respectively, as well as through the passages 24 and 25 of respective handles 4 and 5. Finally, the outer-ends of each set of strings is attached to adjusting screws 26 and 27, respectively. At one end of the housing 8 is a flat ring 28 having screw holes 29 formed so that housing lid 30 can be attached using screws 31 which pass through holes 32 in said housing lid 30. The housing lid 30 when attached, is flush with the surface of the body 1. The inner layer of sponge 2 and outer velvet-like layer 3 are then applied.

Figure 3:
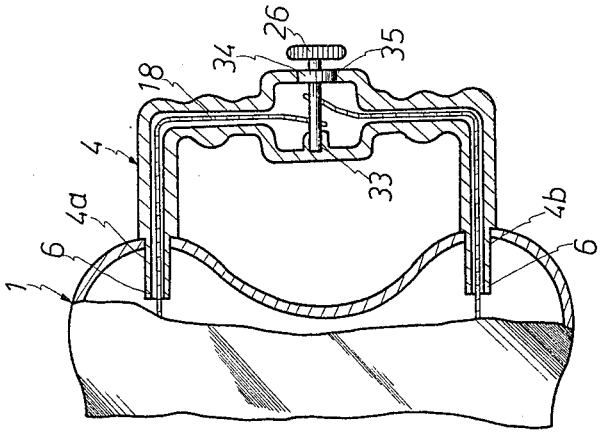
FIG. 3 is a sectional view of a handle of this invention.

FIG. 3 shows a sectional view of handle 4 which is identical to handle 5. In handle 4, the terminals 4*a* and 4*b* are fitted into the holes 6. In the center of handle 4, there is a thicker portion which comprises a hollow post, which post has a pedestal base 33 and a top through which there is a hole 34. An adjusting screw 26 is fitted through the hole 34 into the pedestal base 33. The screw 26 is pulled out and rotated to adjust the length of the strings 18 after which it is pushed back in to lock it. There is a nut-type fixing key 35 on the adjusting screw 26 which can be driven into hole 34 to prevent the screw 26 from rotating and thus fix the length of the strings 18. The ends of the strings 18 are shown as passing through screw 26 as a means of attaching them.

Figure 4:
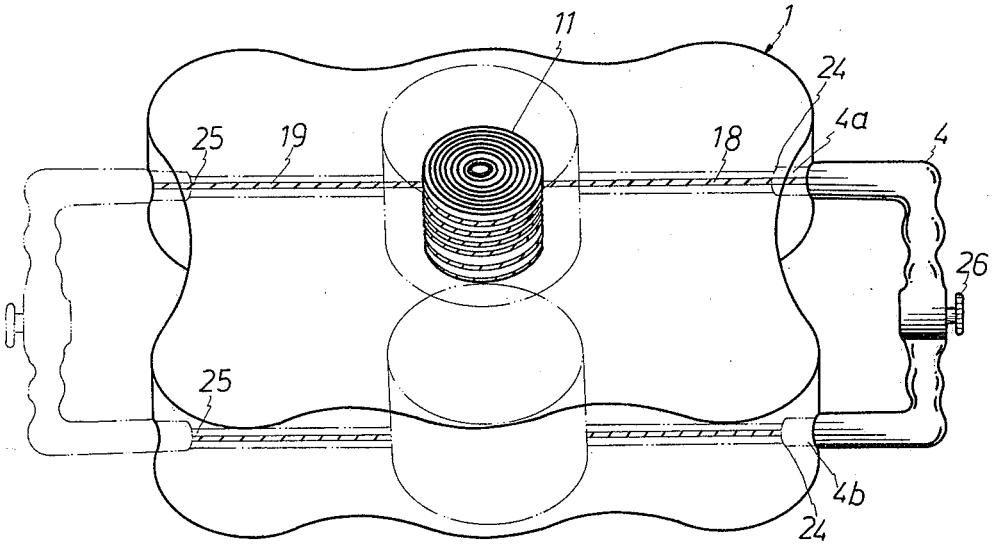
FIG. 4 is a perspective view of a coil spring before tension has been applied by pulling-out the handles.

FIG. 4 shows that when an external force applied to the strings 18, 19 is absent, the recovering force of the coil spring 11 will retract the strings 18, 19 back into the cylindrical housing 8.

Figure 5:
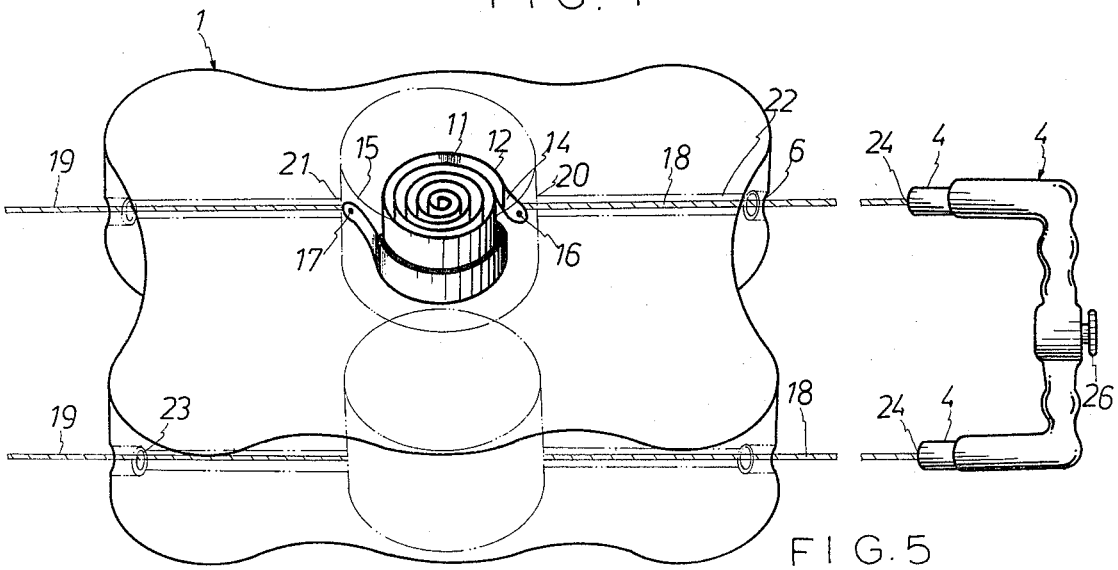
FIG. 5 is a perspective view of the coil spring of FIG. 4 in which tension is fully applied by pulling out the handles to their maximum.

FIG. 5 shows that when the handles 4, 5 are pulled out the leaf springs 12, 13 would unwind until the lug pieces 14, 15 come into contact with the cylindrical housing 8 near holes 20, 21, at which point they are stopped and the strings 18, 19 cannot be pulled out any further.

I claim:

1. A bathing brush comprising:

a body member containing two coil springs each contained within a cylindrical housing;

housing lids mounted on top of said housings two pair of strings, wherein springs and retractable within the housings;

a pair of handles each connected to one set of said strings;

a sponge inner layer covering said body member; and a velvet-like outer layer covering said sponge.

2. A bathing brush as claimed in claim 1 wherein each said coil spring comprises two leaf springs wherein one leaf spring is longer than the other by a distance equal to half the inner circumference of said cylindrical housing and there are holes in the housing which are of a smaller diameter than the width of said leaf spring whereby the pulling of said string is stopped by the contact of one end of the leaf spring against said hole in said housing.

3. The bathing brush as claimed in claim 1 wherein said handles have terminals and said body member has end holes to accomodate said handle terminals.

4. The bathing brush as claimed in claim 1 wherein each said handle is hollow and has a C shape having terminals and an adjusting screw to which said strings are attached, said screw passing through a nut-type fixing key mounted in a hole in said handle.

5. The bathing brush as claimed in claim 4, wherein the length of said strings is adjusted by pulling-out said fixing key from said hole and wrapping said strings about said screw by rotating the same.

* * * * *